US009308661B2

(12) United States Patent
Este et al.

(10) Patent No.: US 9,308,661 B2
(45) Date of Patent: Apr. 12, 2016

(54) DEVICE AND METHOD FOR SINGLING OUT PRODUCTS

(75) Inventors: Flavio Este, Selvazzano Dentro (IT); Roberto Vecchi, Spilamberto (IT)

(73) Assignee: SWISSLOG ITALIA S.P.A., Milan (IT)

( * ) Notice: Subject to any disclaimer, the term of this patent is extended or adjusted under 35 U.S.C. 154(b) by 220 days.

(21) Appl. No.: 13/814,604

(22) PCT Filed: Aug. 3, 2011

(86) PCT No.: PCT/IB2011/053455
§ 371 (c)(1),
(2), (4) Date: Feb. 6, 2013

(87) PCT Pub. No.: WO2012/020354
PCT Pub. Date: Feb. 16, 2012

(65) Prior Publication Data
US 2013/0133489 A1 May 30, 2013

(30) Foreign Application Priority Data
Aug. 11, 2010 (IT) ..... BO2010A0519

(51) Int. Cl.
*B65B 61/06* (2006.01)
*B26D 3/10* (2006.01)
(Continued)

(52) U.S. Cl.
CPC ..... *B26D 7/018* (2013.01); *B26D 5/007* (2013.01); *B26D 7/086* (2013.01); *B26F 1/382* (2013.01);
(Continued)

(58) Field of Classification Search
CPC ..... B26D 7/018; B26D 5/007; B26D 7/086; B26D 1/045; B26D 5/005; B26F 1/382; B65B 61/06; Y10T 83/162; Y10T 83/5669; Y10T 83/04
USPC ..... 83/412–414, 477.2, 956
See application file for complete search history.

(56) References Cited

U.S. PATENT DOCUMENTS 4,892,020 A * 1/1990 Kozyrski et al. ..... 83/463
5,205,196 A * 4/1993 Blaimschein ..... 83/272
(Continued)

FOREIGN PATENT DOCUMENTS

CN 2458116 Y 11/2001
DE 42 08 563 A1 9/1993
(Continued)

OTHER PUBLICATIONS

Office Action with English translation issued in Chinese Application No. 201180038955.0 dated Dec. 27, 2013 (10 pages).
(Continued)

*Primary Examiner* — Stephen Choi
(74) *Attorney, Agent, or Firm* — Flynn, Thiel, Boutell & Tanis, P.C.

(57) ABSTRACT

A device for singling out products that are grouped in blister packs or similar multiple packages includes a support structure for at least one multiple package to be singled out, with a bearing surface defining a reference plane. A holding device can be activated selectively in order to hold the at least one multiple package against the bearing surface. A cutting head includes a cutting unit, preferably an ultrasound unit, with a device for cutting the multiple package, and a control is operatively connected to the cutting head and to the holding device in order to control relative movement between the cutting unit and the multiple package in accordance with a cutting scheme which is predetermined or is defined in real time, and which depends on the configuration of the multiple package.

10 Claims, 2 Drawing Sheets

Figure 1:
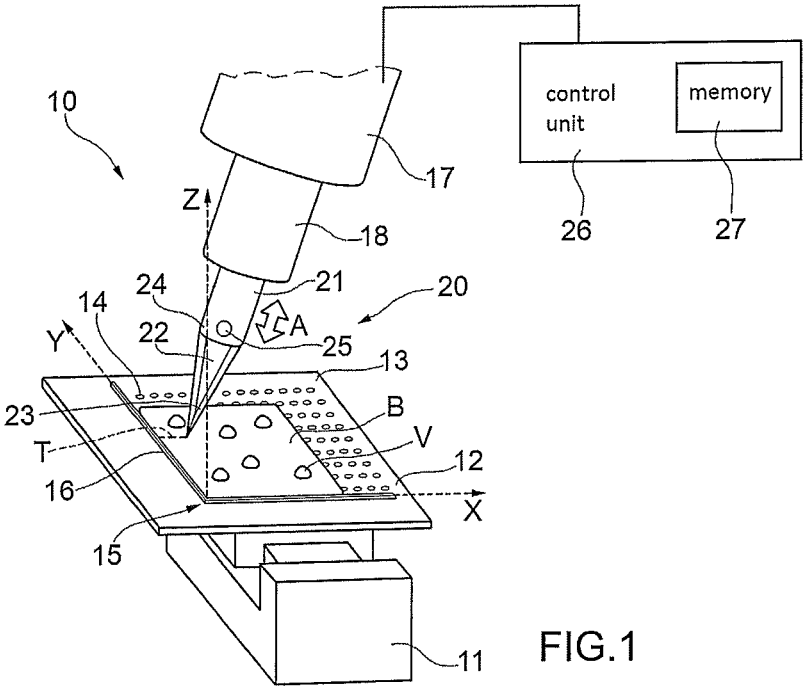

(51) Int. Cl.

| | |
|---|---|
| ***B26D 7/01*** | (2006.01) |
| ***B26D 7/08*** | (2006.01) |
| ***B26F 1/38*** | (2006.01) |
| *B26D 1/04* | (2006.01) |
| *B26D 5/00* | (2006.01) |

(52) U.S. Cl.
CPC ..... *B65B 61/06* (2013.01); *B26D 1/045* (2013.01); *B26D 5/005* (2013.01); *Y10T 83/04* (2015.04); *Y10T 83/162* (2015.04); *Y10T 83/5669* (2015.04)

(56) References Cited

U.S. PATENT DOCUMENTS

| | | | | |
|---|---|---|---|---|
| 5,630,347 | A * | 5/1997 | Elvio | 83/210 |
| 5,792,290 | A | 8/1998 | Huber | |
| 5,883,357 | A * | 3/1999 | Newman et al. | 219/121.67 |
| 6,029,555 | A * | 2/2000 | Naldi | 83/451 |
| 6,250,188 | B1 * | 6/2001 | Sato et al. | 83/35 |
| 7,540,222 | B2 * | 6/2009 | Kim | 83/84 |
| 2006/0288833 | A1 * | 12/2006 | Lachance | 83/76.6 |
| 2007/0044608 | A1 * | 3/2007 | Franke | 83/39 |
| 2009/0188359 | A1 * | 7/2009 | Arshad et al. | 83/167 |
| 2009/0223029 | A1 * | 9/2009 | Leung | 24/698.1 |

FOREIGN PATENT DOCUMENTS

| | | |
|---|---|---|
| EP | 0 189 909 A2 | 8/1986 |
| EP | 1 560 756 A1 | 8/2005 |
| GB | 2 087 290 A | 5/1982 |

OTHER PUBLICATIONS

Form PCT/IPEA/416 mailed Oct. 8, 2012 (1 page).
Form PCT/IPEA/409 mailed Oct. 8, 2012 (5 pages).
Response dated Aug. 24, 2012 responding to Written Opinion mailed Jul. 25, 2012 in Application No. PCT/IB2011/053455 (2 pages).
Form PCT/ISA/220 mailed Nov. 8, 2011 (1 page).
Form PCT/ISA/210 mailed Nov. 8, 2011 (3 pages).
Form PCT/ISA/237 mailed Nov. 8, 2011 (6 pages).

* cited by examiner

DEVICE AND METHOD FOR SINGLING OUT PRODUCTS

The present invention relates to a device and to a method for singling out products, in particular products that are grouped in blister packs and similar multiple packages.

The invention has been developed particularly, although in non-limiting manner, in relation to a device for singling out products such as unitary doses of medicaments that are grouped in blister packs, by the separation of portions of the blister pack each containing a single product.

As is known, medicaments such as tablets, pills, capsules and the like are usually packaged in single doses which are grouped in blister packs. As is well known, a blister pack comprises a substrate with a series of bubble-like compartments in which the tablets or the like are housed. A closure film is extended flat over the substrate and seals the bubble-like compartments which contain the tablets. Alternatively, the tablets may be enclosed in compartments that are created between two flexible films that are welded together.

Blister packs represent a convenient packaging solution for people who have to use medicaments occasionally but are much less easy to use in a hospital environment where the medicaments are preferably stored separately in single doses for more precise and regular distribution in the various departments, according to the posology required by each patient.

The advent of automated systems for the control of medicaments in the hospital environment necessitates the provision of machinery which automatically separates the individual doses that are grouped in blister packs.

There are known singling devices that are suitable for this purpose such as, for example, the device described in the Applicant's European patent EP 1 560 756, in which two pairs of blades cut the blister pack along predetermined straight lines so as to separate the compartments of the blister pack each containing a unitary dose of medicament. Although the device known from this European patent has been found effective in most applications, it is not suitable for use with some types of blister pack in which the bubble-like compartments are arranged in a complex layout.

The objective of the present invention is to provide a device which is useful and convenient for singling out products that are grouped in blister packs of any type, or in similar multiple packages, and which therefore solves the problems of the prior art. Another objective of the present invention is to provide a device for singling out products which is simple and economical, safe in use, and such as not to alter the medicaments or to produce waste or fumes or, in any case, potentially damaging or polluting waste products.

In order to achieve the objectives indicated above, the subject of the present invention is a device of the type indicated in the appended claims.

The use of an ultrasound cutting head permits precise and rapid cutting without waste or fumes, with a high degree of flexibility of use for the cutting of blister packs even with very complex layouts. Relative movement between the cutting head and the blister packs is advantageously controlled by a processor which guides the movements of one or of the other along predetermined paths in a plane parallel to the supporting surface so as to perform the desired cuts. However, it is also possible for the above-mentioned movements not to be predetermined but to be decided at the time in question, by the control software, on the basis of information, for example, coming from a vision system 100 or from a 3D profiler.

Figure 2:
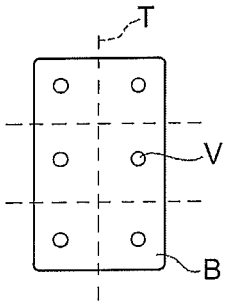
Figure 3:
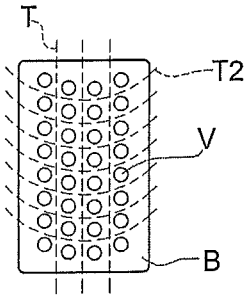
Figure 4:
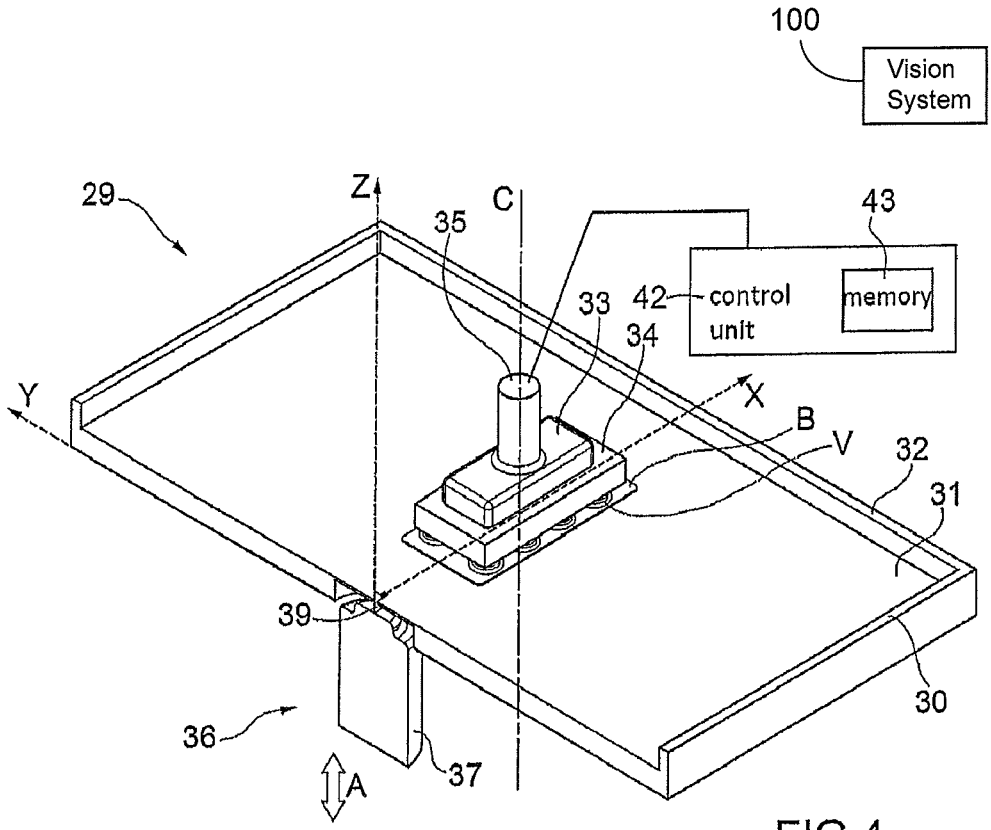
Figure 5:
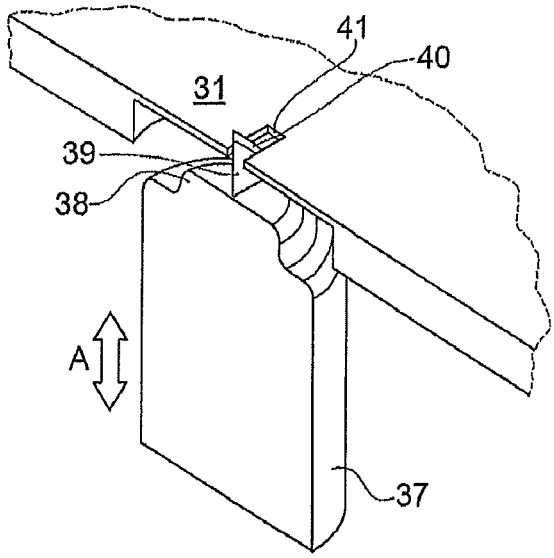

Further characteristics and advantages will become clear from the detailed description of two preferred embodiments of the invention which is given below with reference to the appended drawings, provided purely by way of non-limiting example, in which:

FIG. 1 is a schematic, perspective view of a device for singling out products according to the present invention, FIG. 2 is a schematic example of cuts which can be performed along simple paths, in particular straight paths, with a device of the invention, FIG. 3 is a schematic example of cuts which can be performed along complex paths with the device of the invention, FIG. 4 is a simplified perspective view of a singling out device according to a second embodiment of the present invention, and FIG. 5 shows a detail of the device of FIG. 4 on an enlarged scale.

With reference now to FIG. 1, this shows a device 10 for singling out products that are contained in bubble-like compartments V of a blister pack B which is positioned for cutting. The device 10 comprises a base body 11 on which is mounted a perforated plate 12 that defines a bearing surface extending in a reference plane having coordinates X-Y.

The lower surface of the perforated plate 12 is in communication, in accordance with a known technique, with a duct that is connected to a suction pump (not shown in the drawing) which draws in air from the holes 14 formed in the perforated plate 12.

Reference means 15 are preferably provided on the perforated plate 12 for a blister pack B which rests with its flat surface on the bearing surface 13. In the non-limiting embodiment of FIG. 1, the reference means 15 are constituted by an "L"-shaped, raised portion 16 which defines the origin of the plane X-Y and thus provides a reference for the positioning of the blister pack in abutment.

In an alternative embodiment, the blister pack B rests on the bearing surface 13 with its surface remote from the flat surface, that is, in an inverted position with respect to that described above. Although it is more difficult to keep the blister pack in position in this arrangement, the advantage of reduced wear of the cutting tool is achieved since the tool does not come into abutment with the bearing surface 13 and, moreover, it is easier to grip the blister pieces once the pack has been cut. Moreover, this alternative embodiment is of course the only one that is possible if the blister pack does not have a flat surface but has two surfaces both having "bubbles" or portions in relief. In this latter case, the blister pack B will preferably be placed on the bearing surface 13 on the side on which the "bubbles" or relief portions project least.

Above the base body 11, a cutting head 20 is mounted on a movement device 17 of generally known type having a general capacity for displacement in a plane parallel to the reference plane X-Y as well as a capacity to move towards and away from the bearing surface 13. An appendage 18 extends from the movement device 17 and supports an ultrasound oscillator 21 of generally known type. Fixed to the lower end 24 of the oscillator 21 is a blade 22 with a cutting edge 23 which may be pointed, as shown in the embodiment of FIG. 1, or may have a different shape (scalpel-shaped, rounded, etc.) and which preferably enables cuts with small radii of curvature to be performed. The blade 22 is fixed to the oscillator 21 by means of a screw, a grub screw 25 or similar fixing means which allow easy replacement.

The movement device 17 is controlled by a control unit 26, for example, an electronic processor which brings about its movement in space both parallel to the plane X-Y and along an axis Z away from the reference plane X-Y, preferably but in non-limiting manner, perpendicular thereto; it may in fact be convenient to move the head towards the blister pack along a non-vertical axis, according to the specific shape of the blade. The control unit 26 can advantageously also control the activation of the ultrasound oscillator 21 in order to synchronize it with the movement of the cutting head 20. The control unit 26 has an internal or external memory 27 in which are stored the instructions for cutting schemes which may even be complex schemes and which are associated with each different type of blister pack. Complex cuts require displacements and lifting movements of the cutting head along the axes X-Y-Z, in a predetermined order.

When the device 10 is in use, a blister pack B is positioned with its flat closure film in contact with the bearing surface 13 of the perforated plate 12, in abutment with the raised portion 16, in the predetermined reference position. When the blister pack B is in the correct reference position, the suction pump communicating with the holes 14 is activated so as to create a reduced pressure which draws the blister pack B against the perforated plate 12, holding it in position. At this point, the control unit 26 brings about activation of the ultrasound oscillator 21 which starts to oscillate with very small movements along its axis in the directions indicated by the arrow A, transmitting its movement to the blade 22 and to the cutting edge 23 thereof. The control unit 26 then brings the cutting edge 23 into contact with the blister pack B by bringing about the displacement of the movement means 17 along predetermined paths and trajectories T, T2 (see FIGS. 2, 3) retrieved from the memory 27.

The reciprocating movement of the blade 22 in the directions indicated by the arrow A, which is brought about by the ultrasound oscillator 21 to which the blade 22 is fixed, causes cutting through the thickness of the blister pack. Several cuts may be performed in sequence in the same blister pack so as to separate from one another the compartments V each containing a unitary dose of a medicament or medicine, so that each unitary dose remains enclosed in its sterile envelope. Particularly useful are cuts along curved or broken trajectories T2, as shown by way of example in FIG. 3, which cannot be performed by apparatus of known type.

After the blister pack has been cut, the individual unitary doses are taken or sent for storage by systems known in the art.

Naturally, the device described may be modified so that the cutting head 20 is kept fixed and the perforated plate 12 is moved instead, so as to achieve the desired relative movement between the blister pack and the blade 22. It is also possible to move the plate in the reference plane X-Y and to move the cutting head along an axis Z away from that plane or vice versa.

With reference now to FIGS. 4 and 5, a device according to a second embodiment of the present invention comprises a base structure (not shown) on which is mounted and fixed a support table 30 with a bearing surface 31 which extends in a reference plane having coordinates X-Y, and with a raised rim 32. Above the support table there is a pressure member 33 for a blister pack B resting with its flat surface on the bearing surface 31. A pad 34 of compressible material such as, for example, rubber, is provided between the pressure member and the blister pack. The pressure member is mounted on a movement device of known type (of which only an end 35 is illustrated) having a general capacity for displacement in a plane parallel to the reference plane X-Y as well as a capacity to move towards and away from the bearing surface 31 and the capability to rotate about an axis C of the pressure member.

Below the support table 30 there is a cutting head 36 which comprises an ultrasound oscillator 37 of generally known type. The device is mounted on an axis Z, regulating the projection of the blade as required. A blade 39 with a cutting edge 40 similar to the blade described in the first embodiment is fixed to the upper end 38 of the oscillator 37. The blade 39 projects above the bearing surface 31 of the support table 30 through a slot 41 formed in that surface and defines the origin of the reference plane X-Y.

The movement device is controlled by a control unit 42, for example, an electronic processor, which brings about its movement in space parallel to the plane X-Y, as well as about the axis C of the pressure member, and along an axis Z away from the reference plane X-Y, preferably but in non-limiting manner perpendicular thereto. The control unit 42 may advantageously also control the activation of the ultrasound oscillator 37 in order to synchronize it with the movement of the pressure member 33. The control unit 42 has an internal or external memory 43 in which are stored the instructions for cutting schemes which may even be complex schemes and which are associated with each different type of blister pack. Complex cuts require displacements along the axes X-Y, rotations and lifting movements of the pressure member, in a predetermined order.

When the device 29 is in use, a blister pack B is positioned with its flat closure film in contact with the bearing surface 31 of the support table 30 in a predetermined reference position. When the blister pack B is in the correct reference position, the pad 34 is placed against the blister pack and is pressed against it by the pressure member 33, keeping the blister pack in position. The control unit 42 then brings about activation of the ultrasound oscillator 37 which starts to oscillate in the directions indicated by the arrow A and transmits its movement to the blade 39, as described for the first embodiment of the invention. The control unit 42 brings about the displacement and the rotation of the pressure member 33 and of the blister pack therewith, and the blister pack slides on the bearing surface until it contacts the cutting edge 40. The relative movement between the blister pack and the oscillating blade 39 brings about cutting through the thickness of the blister pack. In this embodiment also, the movements imparted by the movement means 35 are retrieved from the memory 43 where they have previously been stored.

In an alternative embodiment, it is also possible for the movements not to be predetermined and stored beforehand but to be decided at the time in question, in real time, by the control software, on the basis of information coming, for example, from a vision system or from a 3D profiler connected to the above-described system in known manner.

The individual unitary doses obtained by multiple cuts of the blister pack are then taken or sent for storage by known systems.

Naturally, persons skilled in the art who have understood the teachings indicated above will easily be able to modify the device according to the present invention in order to adapt it for use for separating packets of medicaments in powder form, phials, or multiple packages of medicaments in any other form, in addition to the cutting of blister packs for pills, tablets, capsules and the like. Such modification clearly falls within the scope of the present invention.

It is pointed out that the perforated plate 40 may be replaced by elements with the same functional capabilities, for example, by a grating. In more general terms, the use of other systems for holding the blister pack B on the bearing surface 31 also falls within the scope of the present invention; for example, a system of pincers or the like may be used, particularly although not exclusively when the blister pack B does not rest on the bearing surface with its flat surface or for blister packs which do not have flat surfaces.

Naturally, it is possible to provide for variants which are included within the scope of the present invention, in which the cutting system or the cutting member are of different types, for example, comprising a milling cutter or the like, for example, a small mill with a fast speed of rotation, or similar tools.

With reference to the embodiment shown in FIGS. 4 and 5, the position of the blade 39 relative to the support table 30 may naturally be other than that shown. The blade 39 may, for example, project from a slot 41 formed in a central region of the support table 30 instead of in an edge thereof, in order to render the cutting operations of the blister pack more flexible, even with complex geometry, and also to render the working zone safer since the blade 39 is in a region that is less easily accessible to an operator.

The bearing surface 31 may also have no projecting rim 32 except for a short section, preferably a corner section, the rim optionally being replaced or supplemented by abutment elements which can be used as abutment elements to define the correct reference position of the blister pack B before the cutting is carried out. Naturally, the blister pack B is clamped on the bearing surface 31 by the clamping means comprising the pressure member 33 with a force which is not too great, so as to allow the pressure member 33 to pull the blister pack B along on the bearing surface 31 along a path that is useful for bringing about the desired cutting thereof by the blade 39; neither is the clamping force too small, in order to avoid the blister B moving relative to the pressure member 33 during the movement on the bearing surface 31, in particular when it is brought to bear against the raised rim or the abutment elements which determine the reference position and/or when it is brought into contact with the blade 39 for the cutting operations. The clamping of the blister pack B relative to the pressure member 33 and its capability at the same time to slide on the bearing surface is naturally favoured by a possible difference in the coefficient of friction between the material of the pressure member 33, in particular the rubber pad 34 or similar element, and that of the bearing surface 31. The configuration of the blister pack B with its projections or bubbles facing towards the pressure member 33 and its flat surface in contact with the bearing surface 31 also favours in particular the clamping of the blister pack B relative to the pressure member 33 and its capability to slide relative to the bearing surface 31.

According to a further variant, the blade 39 may be inclined at any angle to the cutting plane, that is, relative to the bearing surface 31.

Naturally, the principle of the invention remaining the same, the forms of embodiment and details of construction may vary widely with respect to those described and illustrated, without thereby departing from the scope of protection of the invention as defined in the appended claims.

The invention claimed is:

1. A device for singling out products that are grouped in blister packs or similar multiple packages, comprising:

a support structure for at least one multiple package to be singled out, comprising a bearing surface defining a reference plane;

a holding device selectively activatable in order to hold the at least one multiple package against the bearing surface, the holding device comprising a movement device having a general capacity for displacing the at least one multiple package in a plane parallel to the reference plane and relative to the bearing surface;

a cutting head comprising a cutting unit for cutting the at least one multiple package; and a control operatively connected to the cutting head and to the holding device in order to control relative movement between the cutting unit and the at least one multiple package in accordance with a cutting scheme depending on a configuration of the at least one multiple package;

wherein the holding device is moved by the control and, in use, moves the at least one multiple package in the reference plane and about an axis perpendicular to the reference plane.

2. The device according to claim 1, wherein the cutting unit is an ultrasound cutting unit and comprises a blade with a substantially pointed cutting edge.

3. The device according to claim 1, wherein the cutting scheme is predetermined, and the control comprises a memory for storing predetermined cutting schemes which are associated with different types of at least one multiple packages to be singled out.

4. The device according to claim 1, wherein the cutting scheme is determined in real time by a vision system.

5. The device according to claim 1, wherein a pad of compressible material is provided between the at least one multiple package and the holding device.

6. The device according to claim 1, wherein the cutting head is disposed on a side of the support structure opposite to the at least one multiple package, and the cutting unit comprises a blade at least partially inserted in a through slot formed in the support structure.

7. The device according to claim 1, wherein the control moves the holding device in intersecting directions to cut the at least one multiple package in the intersecting directions.

8. A method of singling out products that are grouped in blister packs or similar multiple packages, comprising the steps of:

positioning at least one multiple package on a bearing surface defining a reference plane;

holding the at least one multiple package with a holding device which comprises a movement device;

displacing the at least one multiple package with the movement device in a plane parallel to the reference plane, relative to the bearing surface, and about an axis perpendicular to the reference plane; and controlling relative movement between a cutting head comprising a cutting unit and the at least one multiple package, by a control operatively connected to the cutting head and to the holding device, in accordance with a predetermined cutting scheme depending on a configuration of the at least one multiple package so as to cut the at least one multiple package, singling out products thereof.

9. The method according to claim 8, wherein the cutting head is an ultrasound cutting head and has a blade with a pointed cutting edge for performing cuts having complex trajectories.

10. The method according to claim 8, wherein the control moves the holding device in intersecting directions to cut the at least one multiple package in the intersecting directions.

* * * * *